United States Patent [19]

Henderson

[11] Patent Number: 4,738,639

[45] Date of Patent: Apr. 19, 1988

[54] ELECTRICAL PLUG

[75] Inventor: Robert E. Henderson, Dousman, Wis.

[73] Assignee: Electri-Wire Corporation, Brookfield, Wis.

[21] Appl. No.: 55,026

[22] Filed: May 28, 1987

Related U.S. Application Data

[63] Continuation-in-part of Ser. No. 893,768, Aug. 6, 1986, abandoned.

[51] Int. Cl.[4] ..... H01R 13/68

[52] U.S. Cl. ..... 439/622; 337/198

[58] Field of Search ..... 337/197, 198, 201, 213, 337/264; 439/621, 622

[56] References Cited

U.S. PATENT DOCUMENTS

| | | | |
|---|---|---|---|
| 1,875,378 | 9/1932 | Hastings | 337/198 |
| 1,974,700 | 9/1934 | Adams | 337/198 |
| 1,990,176 | 2/1935 | Fried | 337/197 |
| 2,201,427 | 5/1940 | Carr | 337/197 |
| 2,316,163 | 4/1943 | Hignutt | 337/198 |
| 2,428,625 | 10/1947 | Hosmer | 337/263 |
| 2,496,413 | 2/1950 | Sciara | 337/263 |
| 2,528,971 | 11/1950 | Philips | 337/263 |
| 2,668,885 | 2/1954 | Gerlat | 337/198 |
| 2,676,223 | 4/1954 | Whitaker | 337/197 |
| 2,728,828 | 12/1955 | Mason | 337/198 |
| 3,027,438 | 3/1962 | Reutter | 337/167 |
| 3,116,386 | 12/1963 | Sperzel | 337/188 |
| 3,180,955 | 4/1965 | Hubbell et al. | 337/198 |
| 3,198,912 | 8/1965 | Savoca et al. | 337/198 |
| 4,300,113 | 11/1981 | Bronnenhuber | 337/187 |
| 4,571,017 | 2/1986 | Fujita | 439/603 |
| 4,579,405 | 4/1986 | Hirooka | 439/106 |

*Primary Examiner*—Gil Weidenfeld
*Assistant Examiner*—Gary F. Paumen
*Attorney, Agent, or Firm*—Quarles & Brady

[57] ABSTRACT

An electrical plug includes a main plug body defining a cavity with a first fuse receptacle embedded in the cavity. A male electrical connector and second fuse receptable are connected to each other to form an insert, both the first and second fuse receptacles having a substantially hollow cylindrical shape, with the second fuse receptacle including an inward projection adapted to trap a fuse in the second receptacle, wherein the insert is removably received in the outer end section of the plug cavity so that the first and second fuse receptacles are aligned and the male electrical connector extends outside of the plug.

9 Claims, 3 Drawing Sheets

FIG. 5
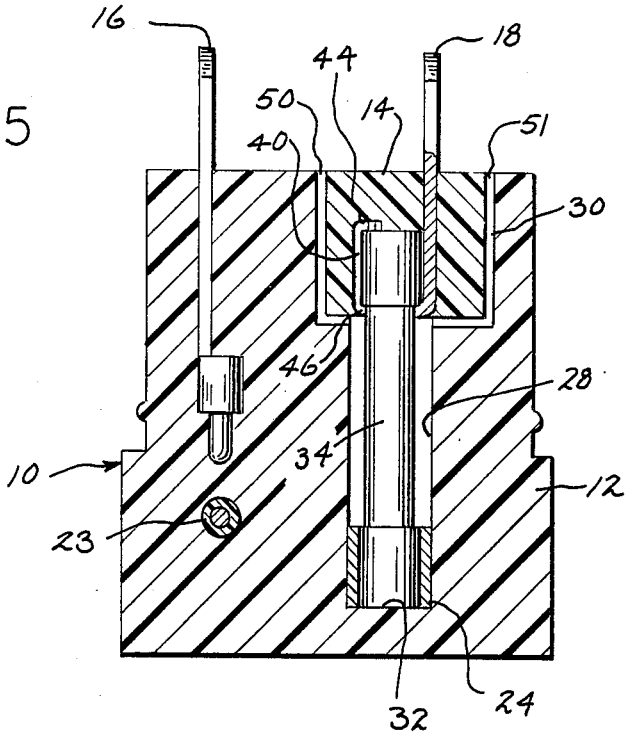
FIG. 6
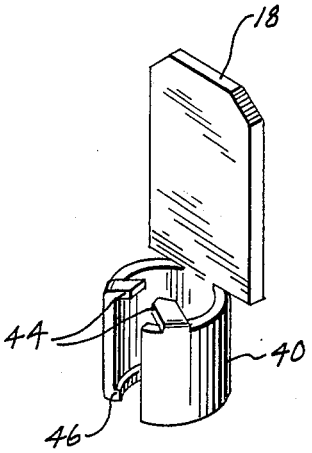
FIG. 7
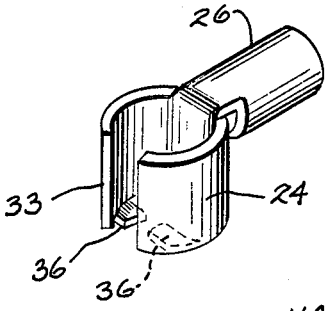
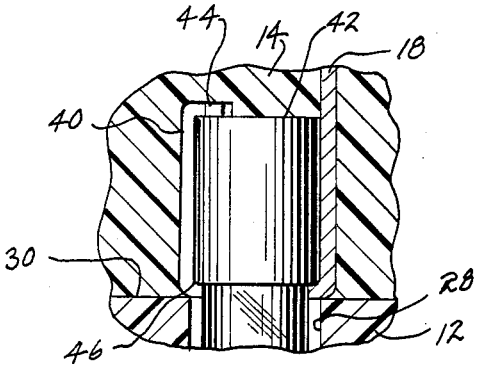
FIG. 8
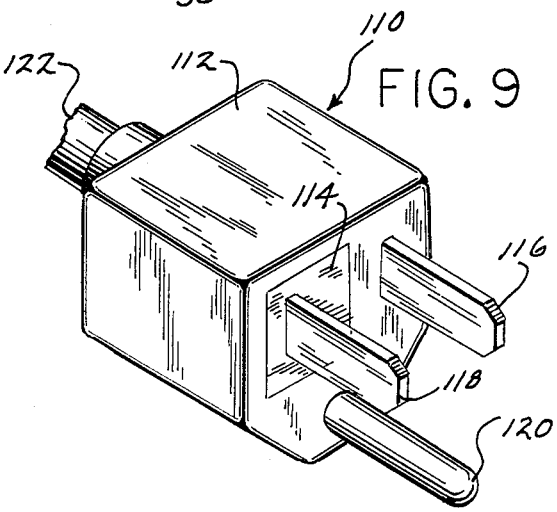
FIG. 9

ELECTRICAL PLUG

CROSS-REFERENCE TO RELATED APPLICATIONS

This application is a continuation-in-part of application Ser. No. 893,768 filed Aug. 6, 1986, now abandoned.

BACKGROUND OF THE INVENTION

This invention relates to electrical plugs, and, in particular, to an electrical plug with a removable fuse.

The benefits of putting a fuse in an electrical plug have been known for some time. The plug is usually the most accessible part of an electrical appliance, so putting a fuse in the plug puts it in a convenient location for insertion and replacement of the fuse. Also, if a fuse is located in the plug of a cord set, it can provide the protection of a fuse to any electrical machine or appliance to which the cord set is attached. In addition, putting a fuse in the plug end of a cord set avoids the problem of overloading the cord in the event of mismatching the cord to the appliance.

When a fuse is put into an electrical plug, it is important to provide for easy removal and replacement of the fuse. It is also important that there be good electrical contact to and from the fuse, that the elements of the construction be sound and not prone to failure, and that the construction be inexpensive to manufacture.

In previous constructions in which one of the male electrical connectors is used as a handle for insertion and removal of the fuse, there is a spring inside the body of the plug for urging the fuse into electrical contact and for ejecting the fuse from the plug when removal of the fuse is necessary. The spring inside the body of the plug is an additional part which increases the complication in installation, increases the expense of manufacture, and which may be lost upon removal of the fuse from the plug. In addition, the constructions which made use of a spring have provided a relatively small surface contact area between the fuse and the interior of the plug body, thereby increasing the chance of problems due to faulty electrical contact.

SUMMARY OF THE INVENTION

The present invention provides a fused plug in which the male electrical connector is used as a handle for removal and insertion of the fuse into the plug. This construction makes good electrical contact over a large surface area between the male connector and the fuse and between the fuse and the wiring which extends from the plug. There are no loose parts in this construction besides the male connector which is removable from the plug body, thereby eliminating extra manufacturing costs and extra problems in assembly and disassembly of the unit. There is no need for a spring to eject the fuse, because the fuse receptacle which is connected to the male electrical connector compresses against the fuse barrel and has a feature which locks the fuse in position so that, when the male electrical connector is removed from the plug, the fuse comes out with it. Unlike previous constructions, and in one embodiment this construction does not require any twisting or bending of the fuse or of the parts to which it is connected for insertion or removal of the fuse because it relies on the projection on the edges of the insert to lock into the main body. The bending and twisting of previous constructions increases the likelihood of failure of the fuse or of one of the connectors. In order to avoid the problems associated with twisting and bending, the fuse of the present invention is inserted directly into position, and the insert is locked in place through a snap-lock, detent arrangement.

In one embodiment, the basic construction includes a plug body which defines a cavity having an outer end section that opens to the outside. There is a first fuse receptacle inside the cavity, and it has a substantially hollow cylindrical shape which is adapted to mate with the cylindrical end of a fuse. A male electrical connector and a second fuse receptacle together form an insert. The second fuse receptacle also has a substantially hollow cylindrical shape, and it includes an inward projection adapted to trap a fuse so that it can be removed with the insert. The insert is removably received in the outer end section of the plug so that the first and second fuse receptacles are aligned and so that the male electrical connector extends outside of the plug.

In another embodiment, the male electrical connector and the second fuse receptacle are permanently embedded in a block of material to provide the insert. The block of material and the cavity provide 90° thread means for holding the second fuse receptacle in the cavity and the second fuse receptacle has entrapment means so that the fuse is removed with the insert.

BRIEF DESCRIPTION OF THE DRAWINGS

FIG. 5 is a view taken along the section 5—5 of FIG. 1;

FIG. 6 is an enlarged, perspective view of the male electrical connector and fuse receptacle combination which is located in the inset portion of th electrical plug of FIG. 1;

FIG. 7 is an enlarged perspective view of the connector and fuse receptacle combination which is located in the main body of the plug of FIG. 1;

FIG. 8 is an enlarged view of the connection between the fuse and the fuse receptacle of the insert which are shown in FIG. 5;

FIG. 9 is a perspective view of a second embodiment of an electrical plug made in accordance with the present invention;

DESCRIPTION OF THE PREFERRED EMBODIMENT

Figure 1:
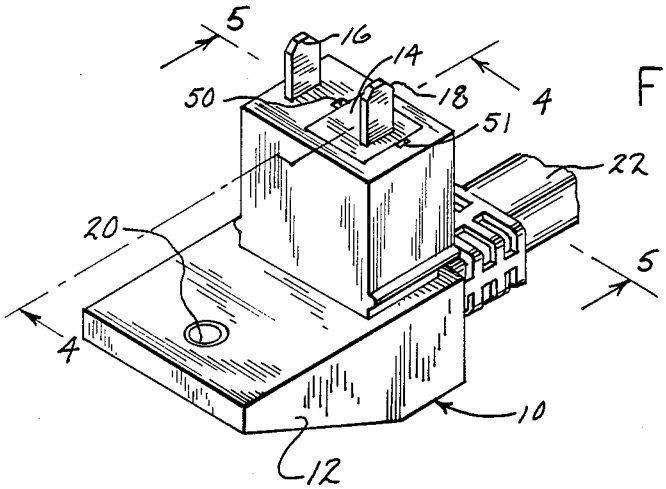
FIG. 1 is a perspective view of an electrical plug made in accordance with the present invention.
Figure 2:
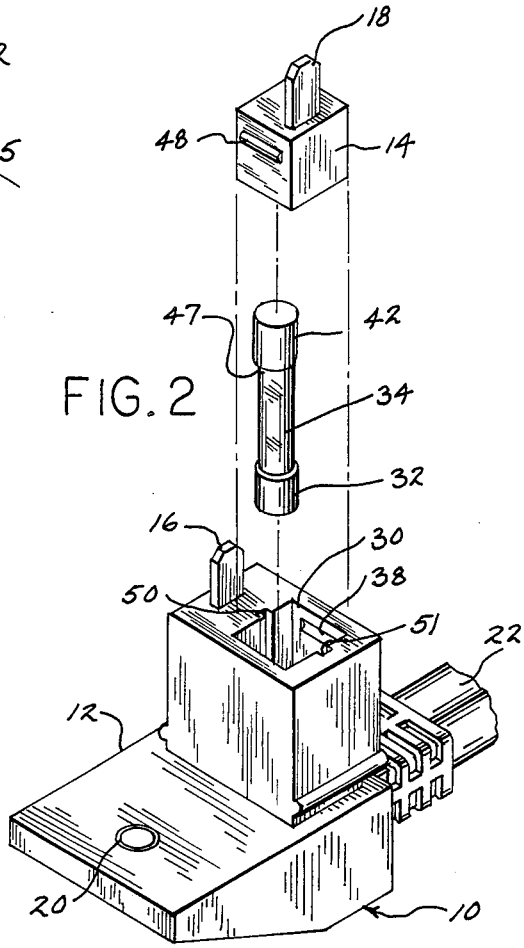
FIG. 2 is an exploded perspective view of the electrical plug shown in FIG. 1.
Figure 3:
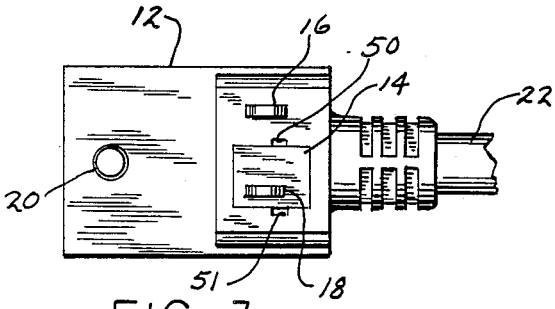
FIG. 3 is a top plan view of the plug shown in FIG. 1.
Figure 4:
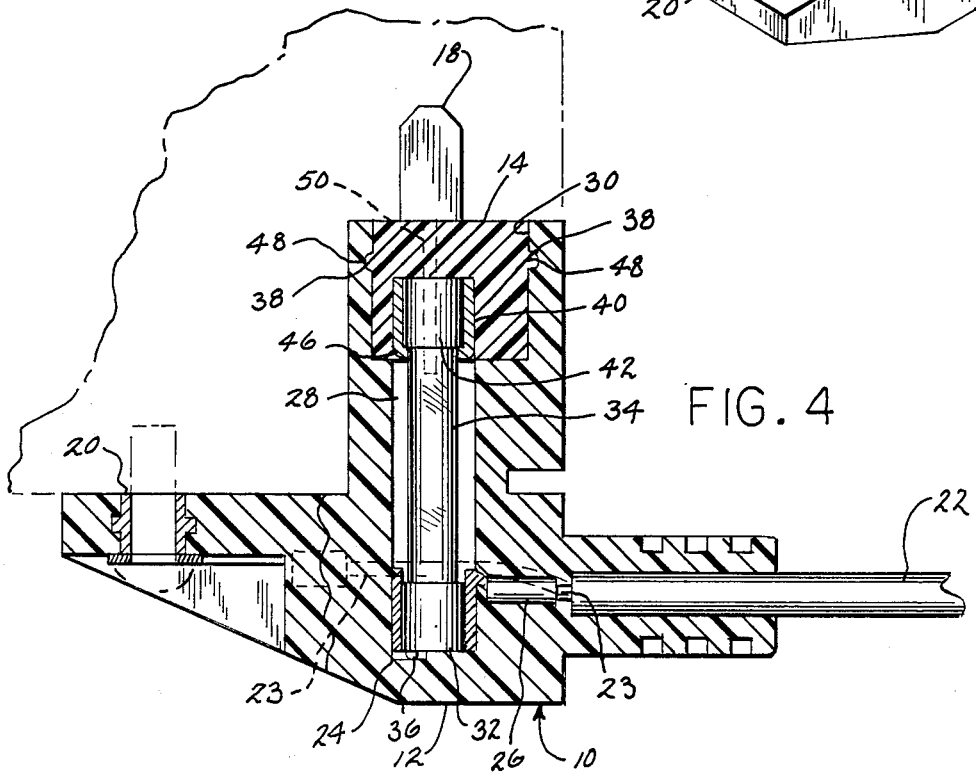
FIG. 4 is a view taken along the section 4—4 of FIG. 1.

The electrical plug 10 and parts thereof shown in FIGS. 1–8 includes a main plug body 12 and an insert 14. The plug 10 has two male electrical connectors 16, 18, a ground contact 20, and an electrical cord 22 including wires 23 which extend out of the plug 10. The shape of this particular electrical plug 10 is unusual, because it was designed for a specific purpose as described in U.S. Pat. No. 4,579,405, which is hereby incorporated by reference. However, the present invention is not limited to this shape of plug and is intended to be used in many types of electrical plugs, including three-prong plugs for wall outlets as shown in FIG. 9.

The wires 23 from the electrical cord 22 connect to the ground 20, to the male blade 16, and to the first receptacle 24 by means of standard crimp-type electrical connectors 26. Of course, the wires 23 could be connected instead by soldering or by other known means.

The main body 12 of the plug 10 is molded from a single piece of polymeric material and includes a cavity 28 which has an outer end section 30 that opens to the outside of the plug body 12. Two U-shaped channels 50 and 51 are provided in outer end section 30 and communicate with the cavity 28. This is to permit heat to escape in case of a blown fuse. The polymeric material is molded around the first fuse receptacle 24, thereby positioning the receptacle 24 at the bottom of the cavity 28, and the crimp connector 26 is an integral part of the first receptacle 24.

The receptacle 24 has a hollow cylindrical shape so that it mates tightly with the first end 32 of the fuse 34. At the bottom of the receptacle 24 are two inwardly bent tabs 36, which stop the fuse 34 when it reaches the bottom of the receptacle 24. Of course, the molded polymeric material below the receptacle 24 would also stop the fuse 34, but the tabs 36 provide more strength as well as greater surface contact area for good electrical contact. Thus, the end 32 of the fuse 34 has electrical contact with the entire inner surface of the receptacle 24 and with the tabs 36.

The outer end portion 30 of the cavity 28 is enlarged and has two opposed, elongated detent grooves 38. The insert 14 is molded as a block of polymeric material and has embedded in it a male connector 18 and a second fuse receptacle 40. The male connector 18 and the second fuse receptacle 40 are made as a single, integral unit connected to each other as shown in FIG. 6, but they could be soldered together or electrically connected in other known ways. This unit shown in FIG. 6, including the male connector 18 and the receptacle 40, comprises the electrically conductive portion of the insert 14, with the rest of the insert 14 merely being a polymeric casing around the electrically conductive portion.

The second receptacle 40, like the first receptacle 24, has a substantially hollow cylindrical shape with a cross-section that terminates short of a complete circle, so that the receptacle 40 can expand and contract in diameter to accommodate the exact size of the second end 42 of the fuse 34 while maintaining good electrical contact. Like the first receptacle 24, the second receptacle 40 has two inwardly projecting tabs 44 at its end, to stop the fuse 34 and to provide greater surface area for the electrical contact with the fuse 34. In addition, the second fuse receptacle 40 has an inward projection or inwardly curled portion 46 which serves to trap the fuse 34 in the fuse receptacle 40 by catching on the inside edge 47 of the metal end 42 of the fuse 34. The inward projection 46 shown in these drawings is coextensive with the entire circumference of the receptacle 40. This construction is preferred, but the projection 46 could also be a plurality of inwardly-bent tabs or other inward projections designed to catch on the inside edge 47 of the end of the fuse 34.

The insert 14 includes two opposed, elongated projections 48 which mate with the elongated grooves 38 in the cavity 28 to positively mate the insert 14 with the main body of the plug 12 with a snap fit. In order to achieve a snap fit, at least one of the members 14 or 12 should be made of a resilient material. Preferably, both parts are molded of the same polymeric material. The male connector 18 extends out of the body of the insert 14 and is in line with the receptacles 40 and 24. The projections 48 are perpendicular to the plane of the male connector 18.

The insert 14 has a rectangular cross-section, and the outer portion 30 of the cavity 28 has a corresponding rectangular cross-section, so that the insert 14 can only be inserted in two orientations and is received with a snug fit. In only one orientation will the fuse 34 properly enter the cavity 28. The rectangular cross-section also prevents the parts from being twisted relative to each other during insertion or removal of the fuse, thereby protecting the parts against damage.

In order to mold the main body 12 of the plug, the electrical parts of the plug 12 are first assembled and held in position, with the crimping attachment portion 26 of the receptacle 24 crimped onto the wire 23 and, likewise, the connections between the wires 23 and the ground 20 and the other male connector 16 also being made. The polymeric material is then molded around those electrically conductive pieces, to form the main body 12. Similarly, the receptacle 40 and the male blade 18 are formed as a unit and then the polymeric material is molded around that unit to form the insert 14, with the receptacle 40 open to the outside of the insert 14 and the male blade 18 extending out of the polymeric material.

In order to assemble the complete electrical plug 10, the fuse 34 is inserted into the receptacle 40 of the insert 14 until the trapping curl 46 catches the inside edge 47 of the metal portion 42 of the fuse 34, thereby trapping the fuse 34 on the insert 14. The fuse 34 is then inserted into the cavity 28 until it mates with the first receptacle 24 and bottom out on the end tabs 36 of that receptacle 24. The dimensions of the plug 10 are such that when the fuse 34 reaches the bottom of the receptacle 24, the projections 48 of the insert 14 snap-fit into the detent grooves 38, so that the entire unit is solidly assembled. The plug 10 can then be used by plugging it into an appliance or other electrical connector.

Figure 10:
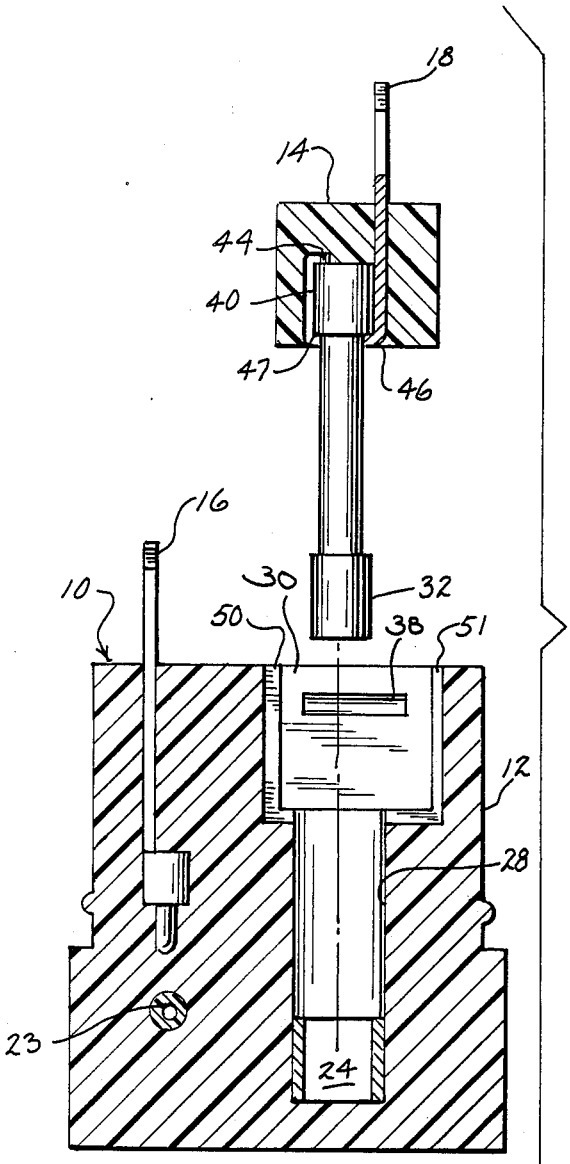
FIG. 10 is a view similar to FIG. 2 illustrating the insert capturing the fuse.

The fuse 34 can be removed by pulling outward on the male connector 18, which pulls the insert 14 out of the main plug body 12 and pulls with it the fuse 34 out of the first receptacle 24. The trapping curl 46 traps the fuse in the receptacle 40 with the engagement with the inside edge 47 of the fuse 34. This is specifically shown in FIG. 10 and prevents the fuse from staying in the first receptacle 24 when the insert 14 is removed. When the insert 14 and fuse 34 have been removed as a unit from the plug body 12, the fuse 34 can then be removed from the receptacle 40 by slightly spreading the receptacle 40 until the curled end 46 slips past the inner edge 47 of the end 42 of the fuse 34 and then sliding the fuse out axially. A new fuse can then be put in place, and the whole unit can again be inserted into the cavity 28 of the main plug body 12.

Thus, installation and replacement of the fuse 34 are done quite simply, without having to use any tools, without the use of extra parts besides the main plug body 12, the insert 14, and the fuse 34, and without having to enter into the body of the appliance to which the plug 10 is connected.

The second embodiment of the invention, shown in FIG. 9, includes a plug 110, having a main body 112 and an insert 114. The plug includes two male electrical connectors 116, 118 and a ground connector 120. An electrical cord 122 extends from the plug. The insert 114 and the internal receptacles (not shown) are identical to those in the first embodiment. The only difference is that the plug 110 is designed to plug into a regular wall outlet.

Figure 12:
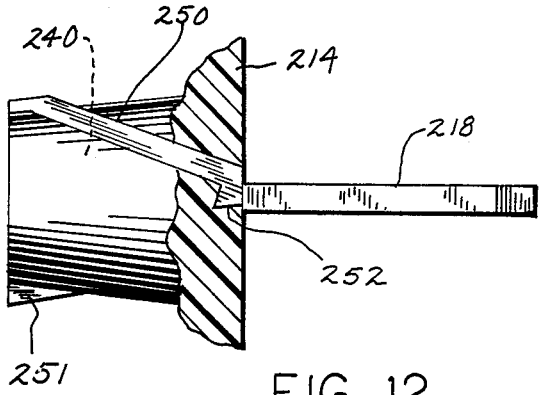
FIG. 12 is an enlarged view partially in section illustrating the insert of FIG. 11.
Figure 11:
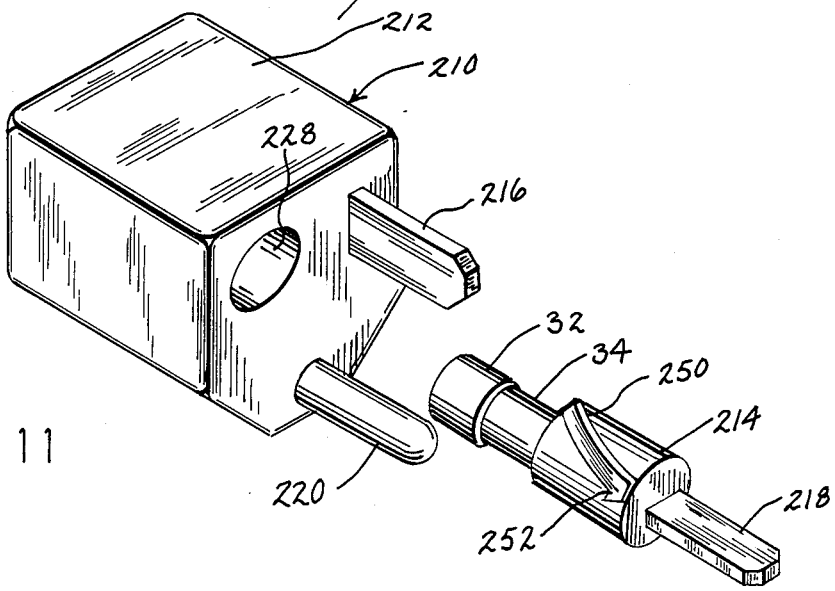
FIG. 11 is an exploded perspective view of a third embodiment.

The third embodiment of the invention, shown in FIGS. 11 and 12, is similar in function to the second embodiment. Similar components are indicated by similar numbers except they are in the "200" series. In this embodiment 210, the insert 214 has a pair of external threads 250 and 251 for reception in complementary internal threads (not shown) in the cavity 228. These threads 250 and 251 are rotated on a 90° helix or spiral. Accordingly, the male connector 218 is in the position in FIG. 11 for insertion into the cavity 228. As the insert 214 is threaded into the cavity it will be turned 90° which brings connector 218 to a position parallel to connector 216. This threaded connection aids in retaining insert 214 in cavity 228. Also assisting in this retention is a detent 252 which projects from each thread 250 and 251 for resilient engagement with a complementary opening in cavity 228 to provide a snap fit arrangement. Fuse receptacle 240 will also include a trapping tap such as 46 for engagement with the fuse 34 and specifically an inside edge such as shown at 47.

It will be obvious to those skilled in the art that modifications may be made to the embodiments described above without departing from the scope of the present invention.

What is claimed is:

1. An electrical plug, comprising:

a dielectric plug body defining a cavity having an outer end section which opens to the outside of said plug body;

a first male electrical connector captured in said plug body;

a first fuse receptacle inside said cavity;

a second male electrical connector and a second fuse receptacle connected to each other, said second fuse receptacle surrounded by a dielectric housing to form an insert, said first and second fuse receptacles having a substantially hollow cylindrical shape and said second receptacle including an inward projection adapted to trap a fuse in said receptacle in a manner such that said fuse is removed with said insert;

wherein said insert is removably received in said outer end section of said plug so that said first and second fuse receptacles are aligned and said male electrical connectors extend outside of said plug.

2. An electrical plug as recited in claim 1, wherein said second male electrical connector and said second fuse receptacle are permanently embedded in said housing which is received in the outer end section of said cavity with a snap fit, said housing and said cavity having at least one mating projection and detent, respectively with at least one of said housing and said plug body being made of a resilient material in order to achieve a snap fit between said mating projection and detent.

3. An electrical plug as recited in claim 2, wherein said first fuse receptacle is connected to a wire which extends out of the body of said electrical plug.

4. An electrical plug as recited in claim 3, wherein the shape of said housing and of the outer end section of said cavity has a noncircular cross section so that the orientation of said housing in said plug body is limited by that shape.

5. An electrical plug as recited in claim 4, wherein said housing has two opposed, elongated said projections in a plane perpendicular to the plane of said second male electrical connector and said cavity has two opposed, elongated said detents which mate with those projections.

6. An electrical plug as recited in claim 1 wherein said second male electrical connector and said second fuse receptacle are permanently embedded in said housing, said of material defining thread means for holding said second fuse receptacle in said cavity.

7. An electrical plug as recited in claim 6 wherein said thread means is defined by a substantially 90° spiral turn.

8. An electrical plug as recited in claim 7 wherein said housing and said plug body are composed of a polymeric material.

9. An electrical plug as recited in claim 6 wherein said housing and said cavity define a retaining detent with at least one of said housing and said plug body being made of a resilient material in order to achieve a snap fit arrangement.

* * * * *

UNITED STATES PATENT AND TRADEMARK OFFICE

CERTIFICATE OF CORRECTION

PATENT NO. : 4,738,639

DATED : April 19, 1988

INVENTOR(S) : Henderson

It is certified that error appears in the above-identified patent and that said Letters Patent is hereby corrected as shown below:

| | |
|---|---|
| ABSTRACT, line 4 | "able" should read --acle-- |
| Column 2, line 42 | "inset" should read --insert--<br>"th" should read --the-- |
| Column 4, line 42 | "bottom" should read --bottoms-- |
| Column 5, line 29 | "tap" should read --tab-- |
| Column 6, line 35<br>(Claim 6) | "said of material" should have been deleted |

Signed and Sealed this

Twenty-fifth Day of April, 1989

*Attest:*

DONALD J. QUIGG

*Attesting Officer*

*Commissioner of Patents and Trademarks*